US005342532A

United States Patent [19]

Takei et al.

[11] Patent Number: 5,342,532

[45] Date of Patent: Aug. 30, 1994

[54] LUBRICATING OIL COMPOSITION COMPRISING ALKYLNAPHTHALENE AND BENZOTHIOPHENE

[75] Inventors: Mitsuhiko Takei, Yokohama; Toshio Yoshida, Kawasaki; Yoshiaki Nagai, Tokyo; Koji Masamizu, Kawasaki, all of Japan

[73] Assignee: Nippon Oil Company, Ltd., Tokyo, Japan

[21] Appl. No.: 949,136

[22] Filed: Sep. 23, 1992

[51] Int. Cl.[5] ..... C10M 135/34; C10M 105/06

[52] U.S. Cl. ..... 252/45; 585/446; 585/455

[58] Field of Search ..... 252/45; 585/446, 455

[56] References Cited

U.S. PATENT DOCUMENTS

| | | | |
|---|---|---|---|
| 2,502,390 | 3/1950 | Reiff et al. | 252/45 |
| 2,528,782 | 11/1950 | Reiff et al. | 252/45 |
| 4,427,561 | 1/1984 | Kusayanagi et al. | 252/45 |
| 4,604,491 | 8/1986 | Dressler et al. | 585/455 |
| 4,714,794 | 12/1987 | Yoshida et al. | 585/455 |
| 5,008,460 | 4/1991 | Garwood et al. | 585/446 |
| 5,034,563 | 7/1991 | Ashjian et al. | 585/455 |
| 5,171,915 | 12/1992 | Forbus et al. | 585/455 |

FOREIGN PATENT DOCUMENTS

| | | |
|---|---|---|
| 0250273 | 12/1987 | European Pat. Off. . |
| 778545 | 12/1934 | France . |
| 59-147096 | 8/1984 | Japan . |
| 59-147097 | 8/1984 | Japan . |
| 63-150231 | 6/1988 | Japan . |
| 2167433 | 5/1986 | United Kingdom . |
| 2168378 | 6/1986 | United Kingdom . |

*Primary Examiner*—Jerry D. Johnson
*Attorney, Agent, or Firm*—Birch, Stewart, Kolasch & Birch

[57] ABSTRACT

A lubricating oil composition comprises an alkylnaphthalene which has one or two alkyl groups each having from 8 to 30 carbon atoms, and at least one member selected from benzo(b)thiophene and derivatives thereof, and naphthalenethiol and derivatives thereof. The composition has good oxidative stability.

14 Claims, No Drawings

LUBRICATING OIL COMPOSITION COMPRISING ALKYLNAPHTHALENE AND BENZOTHIOPHENE

BACKGROUND OF THE INVENTION

1. Field of the Invention

The present invention relates to a synthetic lubricating oil composition having good oxidative stability or oxidation resistance. The present invention also relates to a process for preparing such a composition.

2. Description of the Prior Art

Lubricating oils which are recycled in use should generally stand long-term use. For this purpose, it is usual to employ mineral lubricating oils wherein highly refined mineral oils are formulated with appropriate antioxidants. However, the mineral lubricating oils undesirably have a limitation with respect to the oxidative stability. This makes it difficult to subject the mineral lubricating oil to long-term use such as in machines whose portions to be lubricated are exposed to severe temperature conditions.

Accordingly, synthetic ester lubricating oils such as diesters, polyol esters and the like have been developed and commercialized as having better oxidative stability and have now been in general use. Although these synthetic ester lubricating oils have good oxidative stability, inherent disadvantages are involved in that they suffer hydrolysis to produce acids, cause sealing agents to be swollen and are expensive. Accordingly, limitation is placed on their range of utility.

Hydrogenated products of poly-α-olefins have been widely known as a synthetic lubricating oil having high oxidative stability. The oxidative stability is better than those of mineral oils but is not so high as those of synthetic ester lubricating oils.

Recently, attention has been drawn to high oxidative stability of naphthalene derivatives. There are provided lubricating oil compositions which are obtained by mixing alkylnaphthalenes used as a base oil for the lubricating oil and specific types of compounds at a defined ratio. These are set forth, for example, in Japanese Laid-open Patent Application Nos. 59-147096 and 59-147097. These compositions are not still satisfactory when applied to the fields where high oxidative stability is essentially required.

SUMMARY OF THE INVENTION

It is accordingly an object of the present invention to provide a lubricating oil composition which overcomes the disadvantages of the prior art lubricating oils or oil compositions.

It is another object of the present invention to provide a lubricating oil composition which has better oxidative stability as never been achieved in prior arts and can be applied under severe conditions.

It is a further object of the present invention to provide a process for preparing such a lubricating oil composition.

The above objects can be achieved, according to one embodiment of the invention, by a lubricating oil composition which comprises an alkylnaphthalene having one or two alkyl groups each having from 8 to 30 carbon atoms, and at least one member selected from the group consisting of benzo(b)thiophene and derivatives thereof represented by the following general formula (1) and naphthalenethiol and derivatives thereof represented by the following formula (2)

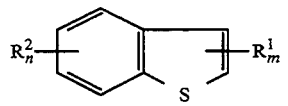

(1)

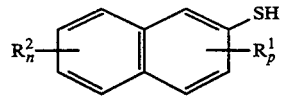

(2)

wherein each $R^1$ and each $R^2$ independently represent a monovalent hydrocarbon group having from 8 to 30 carbon atoms, m is an integer of from 0 to 2, n is an integer of from 0 to 4 and p is an integer of from 0 to 3.

According to another embodiment of the present invention, there is also provided a process for preparing a lubricating oil composition which comprises reacting an alkylating agent with naphthalene to obtain an alkylnaphthalene having one or two alkyl groups each having from 8 to 30 carbon atoms, the reaction being effected in benzo(b)thiophene and/or naphthalenethiol, and collecting the resultant reaction product.

DETAILED DESCRIPTION AND EMBODIMENTS OF THE INVENTION

The synthetic lubricating oil composition of the present invention should comprise an alkylnaphthalene as a base oil. The base oil is an alkylnaphthalene having one or two alkyl groups each having from 8 to 30 carbon atoms or a mixture of the alkylnaphthalenes as defined above.

The type of alkyl group of the alkylnaphthalene greatly influences the properties of final lubricating oil compositions. In the practice of the present invention, the alkyl group may be linear or branched and should have from 8 to 30 carbon atoms, preferably from 12 to 18 carbon atoms. One or two alkyl groups should be contained in the alkylnaphthalene. This means that the total number of carbon atoms of alkyl group or groups ranges from 8 to 60, preferably from 8 to 48 and most preferably from 12 to 36. With alkylnaphthalenes wherein the total number of the alkyl group or groups is less than 8, the resultant lubricating oil composition becomes low in flash point. On the other hand, when the total number of carbon atoms exceeds 60, the pour point of the resultant lubricating oil composition becomes high, unfavorably causing a low temperature pour to be deteriorated.

The alkylnaphthalenes which are especially preferred as a base oil of the lubricating oil composition of the present invention include monoalkylnaphthalenes which have one linear or branched alkyl group having from 12 to 24 carbon atoms, dialkylnaphthalenes which have two linear or branched alkyl groups each having from 8 to 24 carbon atoms, and mixtures thereof. When these compounds are mixed in an appropriate manner, there can be obtained a lubricating oil composition which has a controlled viscosity.

The position of the alkyl group joined to the naphthalene ring is not critical. If two alkyl groups are incorporated in the alkylnaphthalene, the mutual positions of these alkyl groups are also not critical.

The lubricating oil composition of the present invention should further comprise one or more of benzo(b)- thiophene and derivatives thereof represented by the following general formula (1) and naphthalenethiol and derivatives thereof represented by the following formula (2)

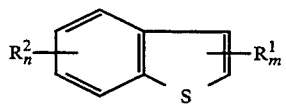

(1)

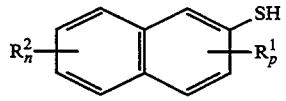

(2)

wherein each $R^1$ and $R^2$ independently represent a monovalent hydrocarbon group having from 8 to 30 carbon atoms and preferably a linear or branched alkyl group although $R^2$ may be a naphthalene group or an alkylnaphthalene group, m is an integer of from 0 to 2, n is an integer of from 0 to 4 and p is an integer of from 0 to 3. In general, m and p are each zero and n is 1.

In the lubricating oil composition of the invention, the amount of the compound of the formula (1) or (2) is in the range of from 0.01 to 5 parts by weight, preferably from 0.03 to 3 parts by weight, per 100 parts by weight of the alkylnaphthalene base oil. If the amount is below the above range, the effect is not so high that high oxidative stability may not be obtained. If the amount exceeds the above-defined range, any further significant effect is not recognized with poor economy. In addition, there is a tendency that sludge is formed in large amounts.

In the process for preparing the lubricating oil composition of the invention, the compound of the formula (1) or (2) may be added to the alkylnaphthalene to obtain a lubricating oil composition. Alternatively and, in fact, preferably, it is effective to add benzo(b)-thiophene or naphthalenethiol at the time of preparation of the alkylnaphthalene to obtain a reaction mixture. This mixture is provided as a lubricating oil composition as it is.

The alkylnaphthalene can be prepared by alkylation of naphthalene with a conventional alkylating agent. Examples of the alkylating agent preferably include linear α-olefines which are obtained by low degree of polymerization of ethylene or pyrolysis or catalytic decomposition of heavy oils and petroleum fractions. By this, there are obtained alkylnaphthalenes having a secondary alkyl group whose alkyl moiety has one branched methyl, ethyl or propyl group and wherein the number of carbon atoms in the alkyl moiety is single or a distribution in the number of carbon atoms is very narrow. The resultant alkylnaphthalene has a good hue.

The α-olefins should preferably be linear in nature and should have from 8 to 30 carbon atoms. Specific examples include 1-octene, 1-nonene, 1-docene, 1-dodecene, 1-tetradecene, 1-hexadecene, 1-octadecene, 1-eicosene, 1-docosene, 1-tetracosene, 1-octacosene, 1-triacontene and mixtures thereof.

In the alkylation reaction, the molar ratio between the alkylating agent and naphthalene is not critical. Preferably, the molar ratio is in the range of not less than 2:1, more preferably from 3:1 to 6:1. If the ratio is less than 2:1, there may occur the case where polymerization of the α-olefin is not negligible. Over 6/1, the yield of an intended product may be lowered.

For the alkylation reaction, it is preferred that there is used, as an alkylating catalyst, hydrogen zeolite Y which is prepared from a silica material such as active silicate or active aluminosilicate obtained by acid treatment of clay minerals as taught in Japanese Laid-open Patent Application No. 63-150231.

The reaction is preferably effected by gradually dropping an alkylating agent in a mixture of molten naphthalene and a catalyst. The dropping time may be arbitrarily determined depending on the molar ratio and the amount of the reaction system and is preferably in the range of from 1 to 7 hours. The dropping rate of the alkylating agent is not critical.

In the preparation of the alkylnaphthalene as described above, when benzo(b)thiophene or naphthalenethiol is added to the reaction system, the resultant reaction mixture may be used as it is as a lubricating oil composition of the present invention. Benzo(b)thiophene or naphthalenethiol is preferably added to the mixture of the naphthalene and catalyst, followed by dropping of the alkylating agent. The amount of benzo(b)thiophene or naphthalenethiol is preferably in the range of from 0.01 to 5 parts by weight per 100 parts by weight of naphthalene.

By the addition of benzo(b)thiophene or naphthalenethiol at the time of the reaction of the naphthalene, the resultant composition exhibits better oxidative stability than those obtained by addition of the compound of the formula (1) or (2) to alkylnaphthalenes, with a reduced amount of sludges.

The synthetic lubricating oil composition of the present invention may further comprise additives for lubricating oils ordinarily used for this purpose. Examples of such additives include antioxidants, detergent dispersants, viscosity index improvers, pour point depressants, oiliness improvers, abrasion resistant agents, extreme pressure agents, metal inactivating agents, corrosion inhibitors, defoamers, emulsifiers, anti-emulsifiers and the like. Details of these additives are set forth, for example, in Journals of the Lubrication Society Vol. 15, No. 5 or "Additives of Petroleum Products" edited by Toshio Sakurai and published by Saiwai Pub.

The synthetic lubricating oil composition of the present invention can be applied as lubricating oils for which oxidative stability is required, e.g. turbine oils, gear oils, hydraulic oils, metal machining oils, slide guiding oils, bearing oils and the like.

The present invention is more particularly described by way of examples, which should not be construed as limiting the invention. Comparative examples are also described.

EXAMPLE 1

384 g (3 moles) of purified naphthalene, 3.8 g of benzo(b)thiophene and 14.0 g of H-Y zeolite (Japanese Laid-open Patent Application No. 63-150231) were placed in a one-liter four-necked flask equipped with a thermometer, an agitating blade, an air-cooling pipe and a dropping funnel, followed by setting on a mantle heater. While agitating, the mixture was heated from room temperature to 210° C. in about 30 minutes. This point was taken as an initiation of the reaction, and 234 g (1 mol) of a mixture of 1-hexadecene and 1-octadecene at a ratio of 50/50 was dropped in the mixture for reaction. The reaction time was 7 hours.

The resultant reaction mixture (lubricating oil composition) was subjected to measurement of oxidative stability according to a rotary bomb-type oxidative stability testing method prescribed in JIS-K2514-3 and also to observations of the copper catalyst used and the amount of sludge formed. Evaluation was made according to the following standard. The results are shown in Table 1.

State of Copper Catalyst

○: the copper catalyst suffered little change in color

Δ: the copper catalyst suffered a change in color to brown ×: the copper catalyst suffered a change in color to black Occurrence of Sludge ○: little occurrence Δ: some deposits found on the test container ×: deposits found entirely on the test container

EXAMPLES 2 AND 3 AND COMPARATIVE EXAMPLE 1

The general procedure of Example 1 was repeated except that 5.7 g and 7.6 g of benzo(b)thiophene were, respectively, used to obtain reaction mixtures (lubricating oil compositions) of Examples 2 and 3 and that benzo(b)thiophene was not used to obtain a reaction mixture (lubricating oil composition) of Comparative Example 1. These mixtures were subjected to similar tests as in Example 1. The results are shown in Table 1.

EXAMPLE 4

The general procedure of Example 1 was repeated except that 3.8 g of naphthalenethiol was used instead of benzo(b)thiophene, thereby obtaining a reaction mixture (lubricating oil composition). The mixture was tested in the same manner as in Example 1. The results are shown in Table 1.

TABLE 1

| | Additive | Amount (g) | Oxidative stability (minutes) | State of copper catalyst | Amount of sludge |
|---|---|---|---|---|---|
| Example 1 | benzo(b)-thiophene | 3.8 | 1300 | ○ | ○ |
| Example 2 | benzo(b)-thiophene | 5.7 | 2000 | ○ | ○ |
| Example 3 | benzo(b)-thiophene | 7.6 | 2800 | ○ | ○ |
| Example 4 | naphtha-lene-thiol | 3.8 | 2800 | ○ | ○ |
| Com-parative Example 1 | no additive | — | 400 | ○ | ○ |

EXAMPLES 5 to 10 AND COMPARATIVE EXAMPLES 2 AND 3

1 part by weight of benzo(b)thiophene or naphthalenethiol was added to 100 parts by weight of the reaction mixture of Comparative Example 1 to provide mixtures of Examples 5 and 6, respectively. Similarly, hexadecylbenzo(b)thiophene was added in amounts of 0.5 and 1 part by weight, thereby providing mixtures of Examples 7 and 8, respectively. One part by weight of octadecylbenzo(b)thiophene was added, thereby obtaining a mixture of Example 9. One part by weight of hexadecylnaphthalenethiol was added, thereby obtaining a mixture of Example 10. These composition were each subjected to an oxidative stability test in the same manner as in Example 1. The results are shown in Table 2.

Additives other than those used in the invention were also used to obtain synthetic lubricating oil compositions for comparison. These compositions were subjected to an oxidative stability test in the same manner as in Example 1. The results are also shown in Table 2.

TABLE 2

| | Additive | Amount (parts) | Oxidative stability (minutes) | State of copper catalyst | Amount of sludge |
|---|---|---|---|---|---|
| Example 5 | benzo(b)-thiophene | 1 | 1050 | ○ | ○ |
| Example 6 | naphtha-lene-thiol | 1 | 1400 | ○ | ○ |
| Example 7 | hexadecyl-benzo(b)-thiophene | 0.5 | 1800 | ○ | ○ |
| Example 8 | hexadecyl-benzo(b)-thiophene | 1 | 2200 | ○ | ○ |
| Example 9 | octadecyl-benzo(b)-thiophene | 1 | 1900 | ○ | ○ |
| Example 10 | hexadecyl-naphtha-lene-thiol | 1 | 2000 | ○ | ○ |
| Com-parative Example 2 | dibenzyl disulfide | 0.5 | 900 | X | X |
| Com-parative Example 3 | triphenyl phosphate | 1 | 100 | X | ○ |

As will be apparent from the above results, the lubricating oil compositions of the invention exhibit better oxidative stability and can be appropriately used in fields where high oxidative stability is required.

What is claimed is:

1. A lubricating oil composition which comprises an alkylnaphthalene having one or two alkyl groups each having from 8 to 30 carbon atoms, and at least one member selected from the group consisting of benzo(b)-thiophene and derivatives thereof represented by the following general formula (1)

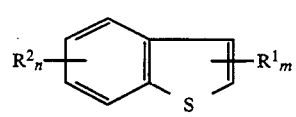

(1)

wherein each $R^1$ and $R^2$ independently represent a monovalent hydrocarbon group having from 8 to 30 carbon atoms, m is an integer of from 0 to 2, and n is an integer of from 0 to 4.

2. A lubricating oil composition according to claim 1, wherein said alkylnaphthalene is a monoalkylnaphthalene which has a linear or branched alkyl group having from 12 to 24 carbon atoms.

3. A lubricating oil composition according to claim 1, wherein said alkylnaphthalene is a dialkylnaphthalene which has two linear or branched alkyl groups each having from 8 to 24 carbon atoms.

4. A lubricating oil composition according to claim 1, wherein said alkylnaphthalene is a mixture of a monoalkylnaphthalene which has a linear or branched alkyl group having from 12 to 24 carbon atoms and a dialkylnaphthalene which has two linear or branched alkyl groups each having from 8 to 24 carbon atoms.

5. A lubricating oil composition according to claim 1, wherein said at least one member is benzo(b)thiophene.

6. A lubricating oil composition according to claim 1, wherein said at least one member is benzo(b)thiophene of the formula (1) wherein $m+n \neq 0$.

7. A lubricating oil composition according to claim 1, wherein in the formula (1) $R^1$ represents a linear or branched alkyl group having from 12 to 20 carbon atoms and m is 1 to 2.

8. A lubricating oil composition according to claim 1, wherein in the formula (1), $R^2$ represents a linear or branched alkyl group having from 12 to 20 carbon atoms and n is 1 to 4.

9. A lubricating oil composition according to claim 1, wherein $R^2$ represents a naphthalene group or an alkylnaphthalene group and n is 1 to 4.

10. A lubricating oil composition according to claim 1, wherein said at least one member is added in an amount of from 0.01 to 5 parts by weight per 100 parts by weight of said alkylnaphthalene.

11. A process for preparing a lubricating oil composition which comprises reacting an alkylating agent with naphthalene in a molar ratio of 2:1 to 6:1 to obtain an alkylnaphthalene having one or two alkyl groups each having from 8 to 30 carbon atoms, the reaction being effected in 0.01 to 5 parts by weight of at least one member selected from the group consisting of benzo(b)-thiophene and derivatives thereof represented by the following general formula (1)

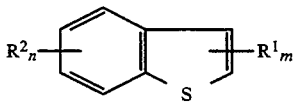

(1)

wherein each $R^1$ and each $R^2$ independently represent a monovalent hydrocarbon group having from 8 to 30 carbon atoms, m is an integer of from 0 to 2, n is an integer of from 0 to 4 per 100 parts by weight of naphthalene, and collecting the resultant alkylating agent, naphthalene and benzo(b)thiophene or benzo(b)thiophene derivative reaction product.

12. A process according to claim 11, wherein said alkylating agent is a linear α-olefin.

13. A process according to claim 11, wherein said alkylating agent is gradually dropped in a mixture of a naphthalene melt and a catalyst for alkylation.

14. A process according to claim 13, wherein said benzo(b)thiophene is added to the mixture prior to the dropping of the alkylating agent.

* * * * *